US005803159A

United States Patent [19]

Nourse, III et al.

[11] Patent Number: 5,803,159

[45] Date of Patent: Sep. 8, 1998

[54] INTEGRATED FIN-HEAT PIPE

[75] Inventors: Roswell W. Nourse, III, Huntsville; Richard A. Reynolds, Guntersville, both of Ala.

[73] Assignee: The United States of America as represented by the Secretary of the Army, Washington, D.C.

[21] Appl. No.: 862,678

[22] Filed: May 23, 1997

[51] Int. Cl.[6] ..... F28F 27/00

[52] U.S. Cl. ..... 165/41; 165/104.26; 244/158 A; 244/3.24

[58] Field of Search ..... 165/104.26, 41, 165/42; 244/158 A, 121, 3.24

[56] References Cited

U.S. PATENT DOCUMENTS

| | | | |
|---|---|---|---|
| 2,941,759 | 6/1960 | Rice et al. | 165/41 |
| 3,450,195 | 6/1969 | Schnacke | 165/104.26 X |
| 3,627,444 | 12/1971 | Lentz | 165/104.26 X |
| 4,671,348 | 6/1987 | Bauer | 165/104.26 X |
| 4,673,030 | 6/1987 | Basiulis | 165/41 X |
| 4,909,316 | 3/1990 | Kamei et al. | 165/104.26 |
| 5,236,151 | 8/1993 | Hagle et al. | 244/158 A X |
| 5,291,830 | 3/1994 | Zwan | 244/158 A X |
| 5,439,351 | 8/1995 | Drtt | 165/104.26 X |
| 5,474,256 | 12/1995 | Garner | 244/3.24 |

*Primary Examiner*—Denise L. Ferensic
*Assistant Examiner*—Christopher Atkinson
*Attorney, Agent, or Firm*—Hugh P. Nicholson; Freddie M. Bush; Hay Kyung Chang

[57] ABSTRACT

To remove excess heat from the fin of a flying object that is driven by a propulsion means, heat pipe principle is integrated into the structure of the fin. The heat from hot exhaust gases that flow over the evaporator section of the fin is absorbed by a working fluid within the fin, such as water, which then vaporizes. The resulting vapors flow to the condenser section of the fin where it releases the heat to the ambient air that flows over the condenser section. As heat escapes into the ambient air, the vapors condense, becoming a liquid again. The liquid travels back to the evaporator section where the heat absorption/vaporization process is repeated.

4 Claims, 3 Drawing Sheets

INTEGRATED FIN-HEAT PIPE

DEDICATORY CLAUSE

The invention described herein may be manufactured, used and licensed by or for the Government for governmental purposes without the payment to us of any royalties thereon.

BACKGROUND OF THE INVENTION

Typically, fins of flying objects such as missiles are subjected to high temperature exhaust flows and must be fabricated of materials that can withstand the high temperatures. Refractory metals and ceramics are some of the suitable materials. If the use of such materials is not practical, then heat sinks, insulations, ablatives or transpiration cooling must be incorporated into the structure of the fins. However, there are disadvantages associated with each of these alternatives as is explained below.

Heat sinks—utilize materials that have a large capacity to store heat. This capacity is directly proportional to the weight of the sink. Hence, these sinks are attractive for short-duration heating environments but are impractical for long exposures to relatively large heating rates because of the correspondingly large weight requirements of the heat sinks.

Insulations—provide a means to block the heat from temperature-sensitive components. These materials offer a very good level of protection provided the application of heat is short in duration. If the heating times are long, excessive thicknesses of the insulation are required, making this particular approach also impractical.

Ablatives—are materials that decompose or change phase when heated, carrying away heat with the decomposition products. Here, too, if exposure times are long, then excessive thickness and weight of the ablative is required.

Transpiration—achieves active cooling by using a coolant that is forced out along the surface of the structure to provide a barrier between the structure and high temperature exhaust gas. This requires that a supply of coolant be carried on board the missile or internal to the fin. This can be impractical requiring excessive space and weight, particularly for long exposure times.

Each of the above-described schemes individually or in conjunction with one another can provide a successful solution if the heating times are short. If the heating times are long, the fin typically must be fabricated of refractory metals or ceramics that is able to withstand very high temperatures (greater than 1500° F.). However, even with these materials, long exposures to heat can lead to the conduction of unwanted heat to other components that are located inside the fin or missile.

SUMMARY OF THE INVENTION

The integration of heat pipe technology into the fin provides a means to transfer the unwanted and detrimental heat to the ambient environment in an efficient manner, thereby eliminating the need to increase the weight of the fin and extending the tolerable exposure times indefinitely.

The integrated fin-heat pipe is comprised of four principal parts: the fin's outer surface through which heat can escape to the atmosphere, a wick and a vapor channel, both internal to the fin, and a working fluid that flows through the wick and vaporizes under the influence of the hot exhaust gases from the propulsion system of the flying object, thereby absorbing the heat that would otherwise increase the temperature of the fin. The vapors travel via the vapor channel from the evaporator section to the condenser section of the fin where it condenses back to liquid as it releases heat which then escapes into the atmosphere.

DESCRIPTION OF THE PREFERRED EMBODIMENT

Figure 1:
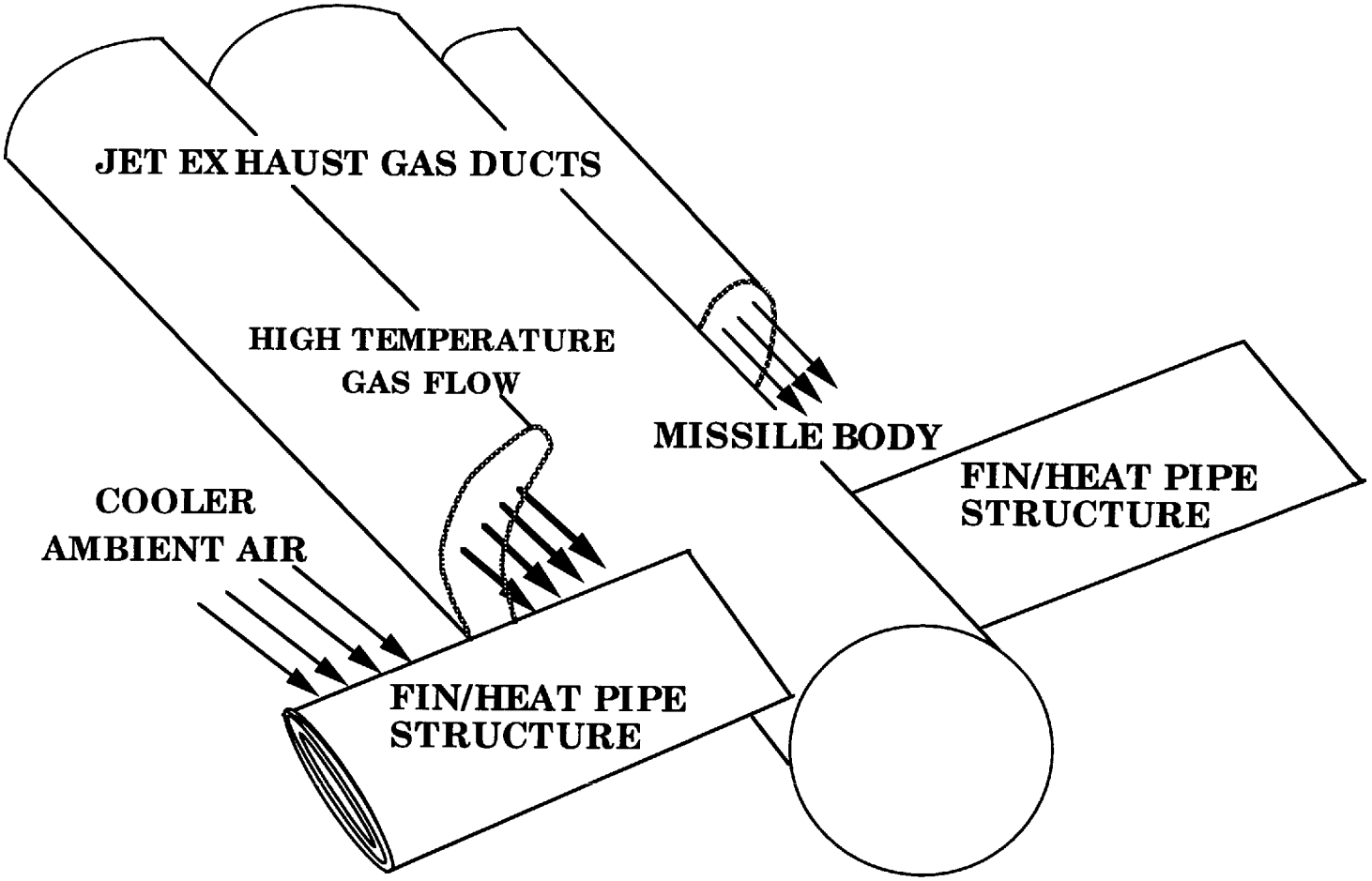
FIG. 1 is an illustration of the flow of hot exhaust gases and cooler ambient air over different sections of the fin of a flying object such as a missile.

Referring now to the drawing wherein like numbers represent like parts in each of the several figures, the structure and operation of the integrated fin-heat pipe is explained.

During launch, high temperature exhaust gases from the jet engine or other propulsion system flow over a portion of the fin of the flying object to provide it guidance while another portion of the fin is extended beyond the reach of the exhaust gases into the ambient air environment. This is illustrated in FIG. 1. When the object is in flight, the ambient air that flows over the portion of the fin that extends into the ambient airstream serves as a sink when the adiabatic wall temperature of the air is significantly lower than that of the exhaust gases. Typically, the heat generated by the high temperature exhaust gases is detrimental to the structure of the fin and must be controlled, reduced or blocked.

Figure 2:
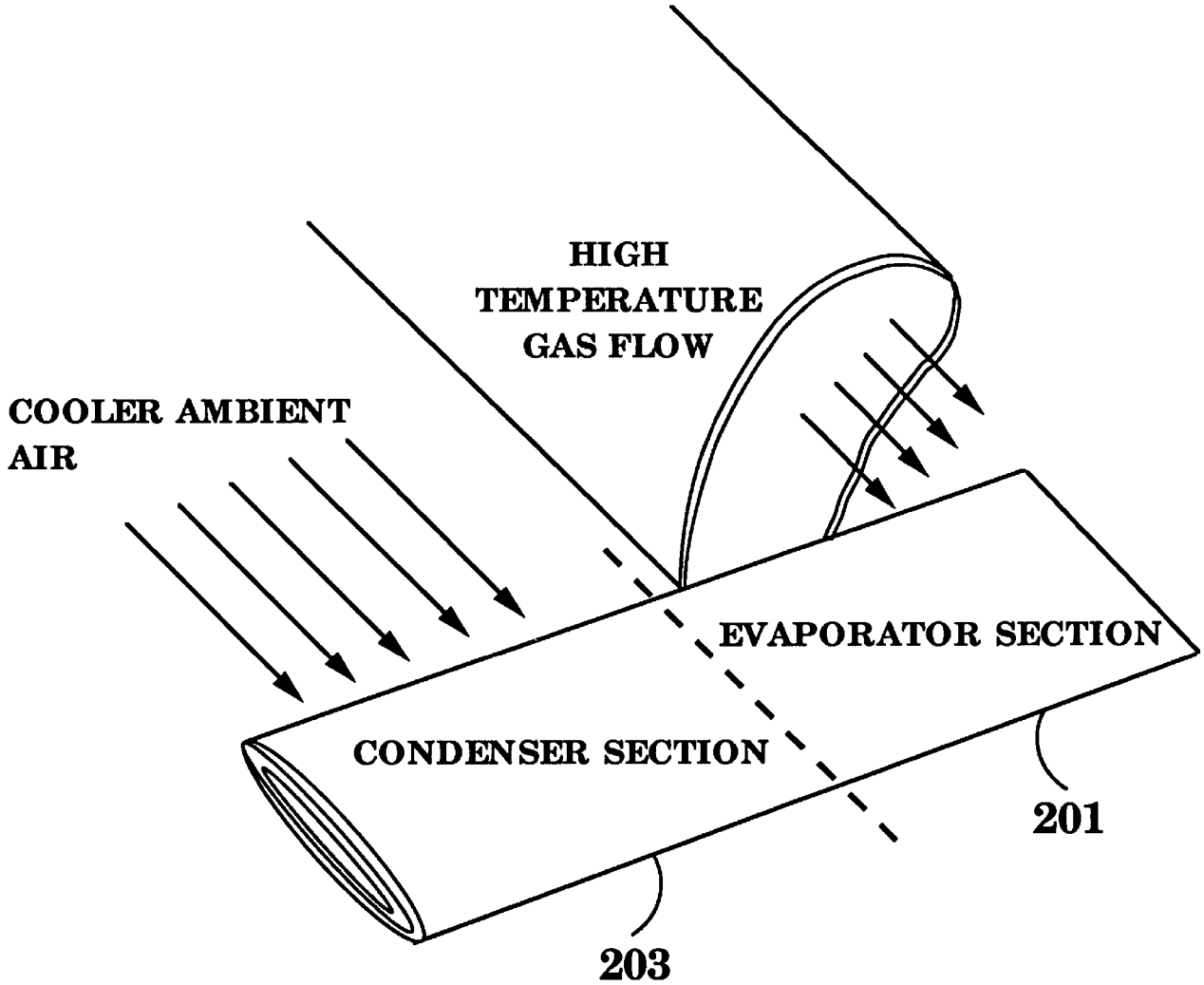
FIG. 2 depicts the evaporator and condenser sections of the fin.
Figure 3:
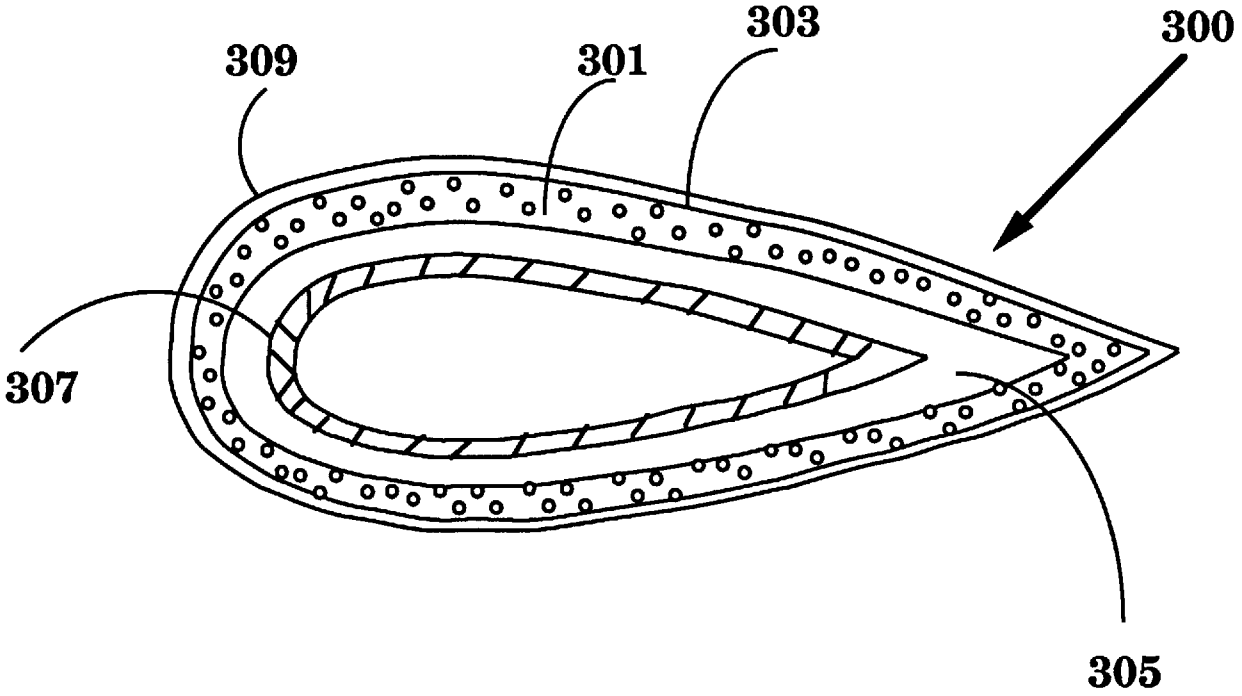
FIG. 3 shows a cross-sectional view of the preferred embodiment of the integrated fin-heat pipe.

As depicted in FIG. 2, when the propulsion system of the flying object ignites, hot exhaust gases flow over evaporator section 201 of the fin of the object to provide control forces during launch. These exhaust gases heat the localized fin structure and cause working fluid 301, such as water, within wick 303 in the evaporator section of the fin to be heated to the point of vaporization, absorbing its latent heat in the process. This heat-absorbing process acts to cool the heated region of the fin to a lower, more acceptable temperature level. The wick, which may be a fine wire mesh, is adjacent to and concentric with the interior surface of fin 300 and holds the working fluid with surface tension until vaporized. The vapor that results, then, naturally flows through vapor channel 305, located between wick 303 and internal wall 307, to condenser section 203 that is extended into the cooler freestream flow. This section of the fin is convectively cooled by the flow of the ambient air due to the forward velocity of the flying object. As heat escapes into the ambient air through outer fin surface 309, the vapor in the vapor channel condenses, becoming a liquid again. Once condensed, the working fluid flows through the wick back to the evaporator section where the heating/vaporization process as described above restarts. Thus, this is a continuous closed cycle, completely self-contained. In this manner, undesirable heat is transferred from a high temperature source to a lower temperature sink. When properly designed, the maximum temperature of the fin structure can be controlled, allowing the use of lighter weight materials such as composites for the fabrication of the fin. Further, theoretically the integrated fin-heat pipe can last in service indefinitely.

The integrated fin-heat pipe may be used on any relatively low speed (less than Mach 2) missile system, plane or any other vehicle utilizing airfoils or fins that are exposed to localized heating from a rocket motor, jet engine or similar propulsion system.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A system for cooling a fin of a flying object, the fin having a given shape and the object being motivated by a propulsion means, the fin consisting of a first portion under the influence of hot exhaust gases from the propulsion means and a second portion in contact with cool ambient air, said cooling system comprising:

A wick located within the fin, said wick being suitable for guiding therethrough the flow of a pre-selected fluid while allowing vapors to escape therefrom upon vaporization of said fluid in the first portion of the fin, said wick being adjacent to and concentric with the interior surface of the fin and an internal wall, said wall mimicking the shape of the fin and being positioned so as to create a vapor channel between said wall and said wick, said channel receiving the vapors escaping from said wick and allowing the vapors to travel to the second portion where the vapors liquidate as heat dissipates into the ambient air, thereby cooling the entire fin.

2. A cooling system as set forth in claim 1, wherein said wick is a fine wire mesh.

3. A cooling system as set forth in claim 2, wherein the fluid, upon liquidation from the vapors, returns via said wick to the first portion of the fin where the fluid is susceptible to repeated vaporization.

4. A cooling system as set forth in claim 3, wherein said pre-selected fluid is water.

* * * * *